United States Patent [19]

Rose et al.

[11] Patent Number: 4,858,396

[45] Date of Patent: Aug. 22, 1989

[54] GUTTER

[76] Inventors: Thomas M. Rose, 6 Hillbrook Rd., Taylors, S.C. 29687; Carlas F. Dixon, 212 Overbrook Rd., Greenville, S.C. 29607

[21] Appl. No.: 207,470

[22] Filed: Oct. 13, 1987

Related U.S. Application Data

[63] Continuation of Ser. No. 762,702, Aug. 5, 1985, abandoned.

[51] Int. Cl.[4] ..... E04D 13/04

[52] U.S. Cl. ..... 52/11; 52/12

[58] Field of Search ..... 52/11, 12, 531

[56] References Cited

U.S. PATENT DOCUMENTS

| | | | |
|---|---|---|---|
| 603,611 | 5/1898 | Nye | 52/12 |
| 691,744 | 1/1902 | Carr | 52/11 |
| 836,012 | 11/1906 | Cassen | 52/12 |
| 873,407 | 12/1907 | Behl | 52/11 |
| 2,669,950 | 2/1954 | Bartholomew | 52/12 |
| 3,248,827 | 5/1966 | Hardy | 52/11 |
| 3,569,978 | 3/1971 | Smith | 52/11 |
| 3,977,145 | 8/1976 | Dobby et al. | 52/531 |
| 4,271,643 | 6/1981 | Sweers | 52/11 |
| 4,404,775 | 9/1983 | Demartini | 52/12 |
| 4,493,588 | 1/1985 | Duffy | 52/12 |

FOREIGN PATENT DOCUMENTS

| | | | |
|---|---|---|---|
| 644352 | 7/1962 | Canada | 52/11 |
| 1012322 | 6/1977 | Canada | 52/11 |

*Primary Examiner*—J. Karl Bell

*Attorney, Agent, or Firm*—Bailey & Hardaway

[57] ABSTRACT

A gutter is illustrated for use beneath the eaves of a shingled roof adjacent a facia board wherein a substantially flat extension which passes beneath the eaves terminates in a free edge adjacent a narrow slot in an apex portion of an extruded synthetic polymeric tube.

1 Claim, 4 Drawing Sheets

GUTTER

This application is a continuation, of application Ser. No. 762,702, filed Aug. 5, 1985 now abandoned.

BACKGROUND OF THE INVENTION

It is generally thought that a large opening such as found in the semi-circular metallic gutter in common use is necessary in order to receive a large flow of water from the shingles of the roof. It has been recognized by prior workers, however, that the flow of water is, even in heavy rains, such as to merely drip off the eaves so that in fact, such a large opening is not necessary. Such was recognized in U.S. Pat. No. 603,611 wherein a unitary integral member has an overhanging portion allowing leaves to drop over the gutter while the rain follows the overhanging surface downwardly and inwardly into the gutter. The prior art is further exemplified by U.S. Pat. No. 836,012 which illustrates a gutter structure having many parts wherein the semi-circular gutter has a surface provided thereabove for conducting water into the gutter while limiting the passage of leaves into the gutter.

Accordingly, it is an important object of the present invention to provide a simplified gutter structure which will not hold leaves and which will not rust or corrode. A further object is to provide a structure providing for thermal expansion and which may be easily erected and maintained.

SUMMARY OF THE INVENTION

It has been found that a gutter for use beneath the eaves of a shingled roof may be provided by utilizing a substantially flat extension member beneath the eaves of the roof for introducing water into a narrow elongated slot carried in an extruded synthetic polymeric tube. The slot is positioned adjacent the apex of the tube and receives water from a free edge of the extension member which terminates adjacent the slot. The tube and the extension member form a gutter assembly for receiving means for positioning the tube adjacent the facia board in such a ray as to provide for thermal expansion together with ease of installation.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

The drawings illustrate a gutter for use beneath the eaves of a shingled roof adjacent a facia board. The gutter includes a substantially flat extension member A extending beneath the eaves of a shingled roof. An extruded synthetic polymeric tube B has a narrow elongated slot C extending adjacent the apex thereof. The extension member extending from the eaves to the slot has a free edge adjacent the slot. The tube and the extension member form an assembly for the gutter. Means D positioning the tube adjacent a facia board. The flat extension member and the tube are preferably integral so that the extension member supports the tube. The means positioning the tube include an elongated slot and a threaded fastening member in the assembly. Preferably the slot is positioned in the extension member, however, the slot may be positioned in the tubular member and the fastening member which passes through the slot provided with an upturned supporting end opposite the slot.

Figure 1:
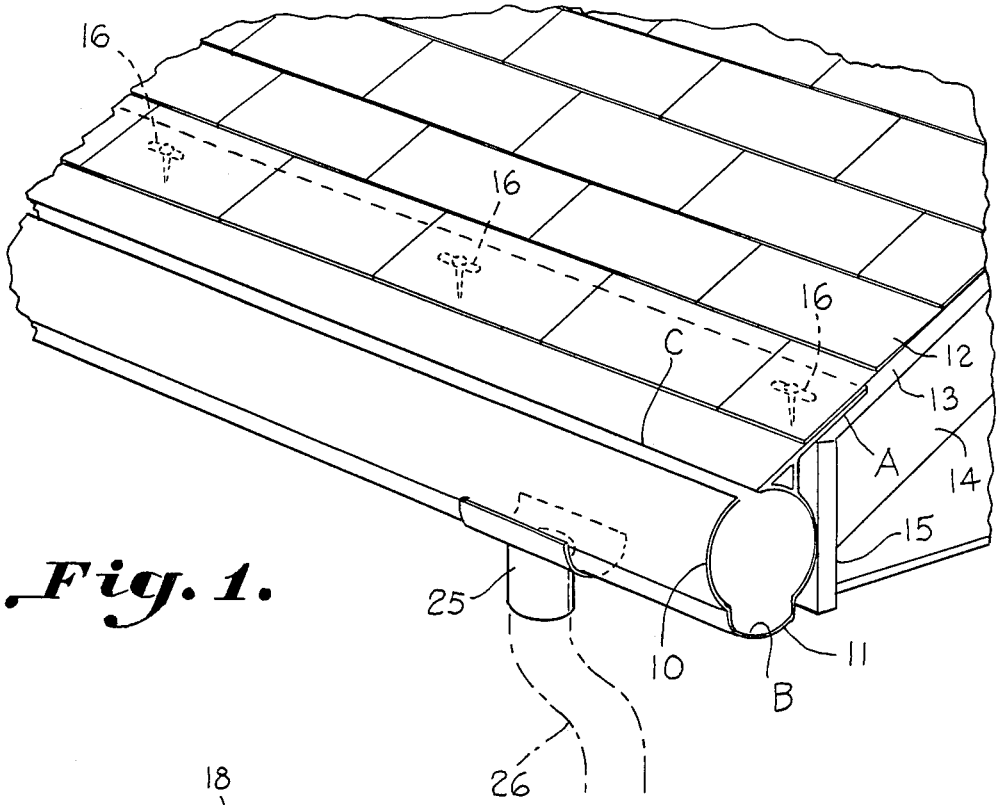
FIG. 1 is a perspective view illustrating the eaves of a shingled roof with facia board provided with a gutter constructed in accordance with the present invention.

FIG. 1 illustrates an embodiment of the invention wherein the substantially flat extension member A is integral with the extruded synthetic polymeric tube B and provides means for positioning the tube adjacent the facia board. The tubular member has a circular upper portion illustrated at 10 and a portion of somewhat less diameter 11 forming the bottom of the tubular circular portion. The roof is illustrated as utilizing shingles 12 of a type which are customarily placed across the roof board 13 which is supported by the usual joist 14 which terminates in a facia board 15.

Figure 2:
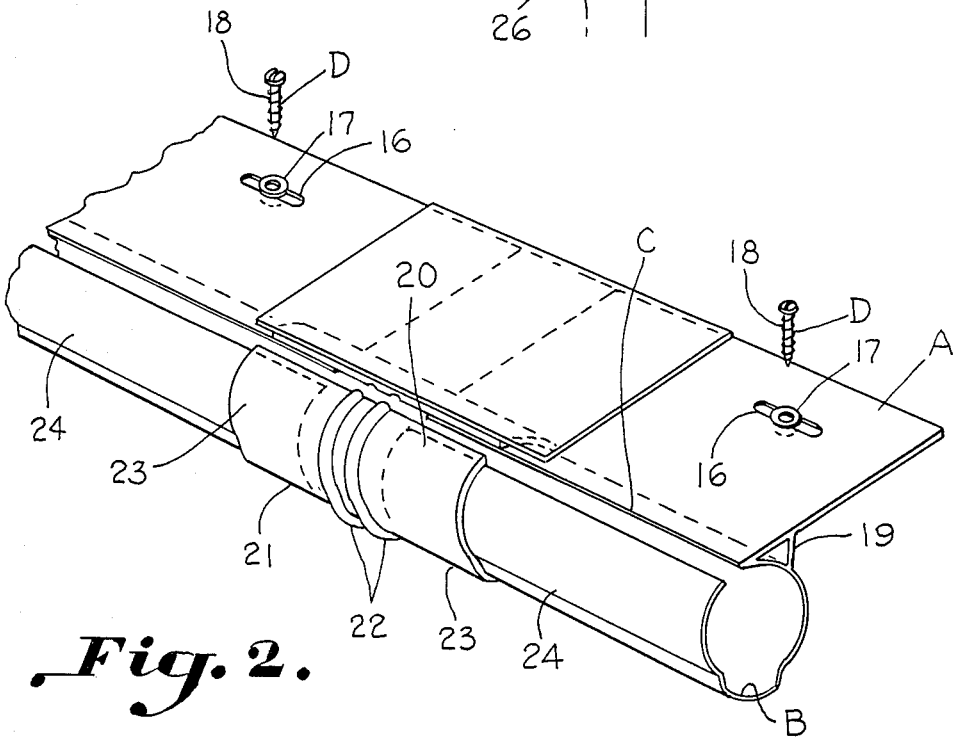
FIG. 2 is a perspective view similar to FIG. 1 further illustrating the parts of the gutter assembly including a connector permitting thermal expansion.

The flat extension member A is illustrated as including longitudinal slots 16 which receive suitable studs 17 which have openings therein for receiving a threaded fastening member 18. The slot and fastening arrangement together with the integral extension member constitute the means D for positioning the tube adjacent the facia board. It will be observed that the flat extension member A and the tube B are rigidly joined as at 19 and may be extruded as a single unit from which sections may be cut to provide space for a plastic connecting member 20. The connecting member has an intermediate portion 21 between expandable ribs 22 to facilitate for expansion and for providing sleeve portions 23 for accommodating ends adjacent tubular sections as illustrated at 24 in FIG. 2. The gutter is illustrated in FIG. 1 as having a T-shape member 25 which acts as a downspout for accommodating a downwardly extending tubular member 26.

Figure 3:
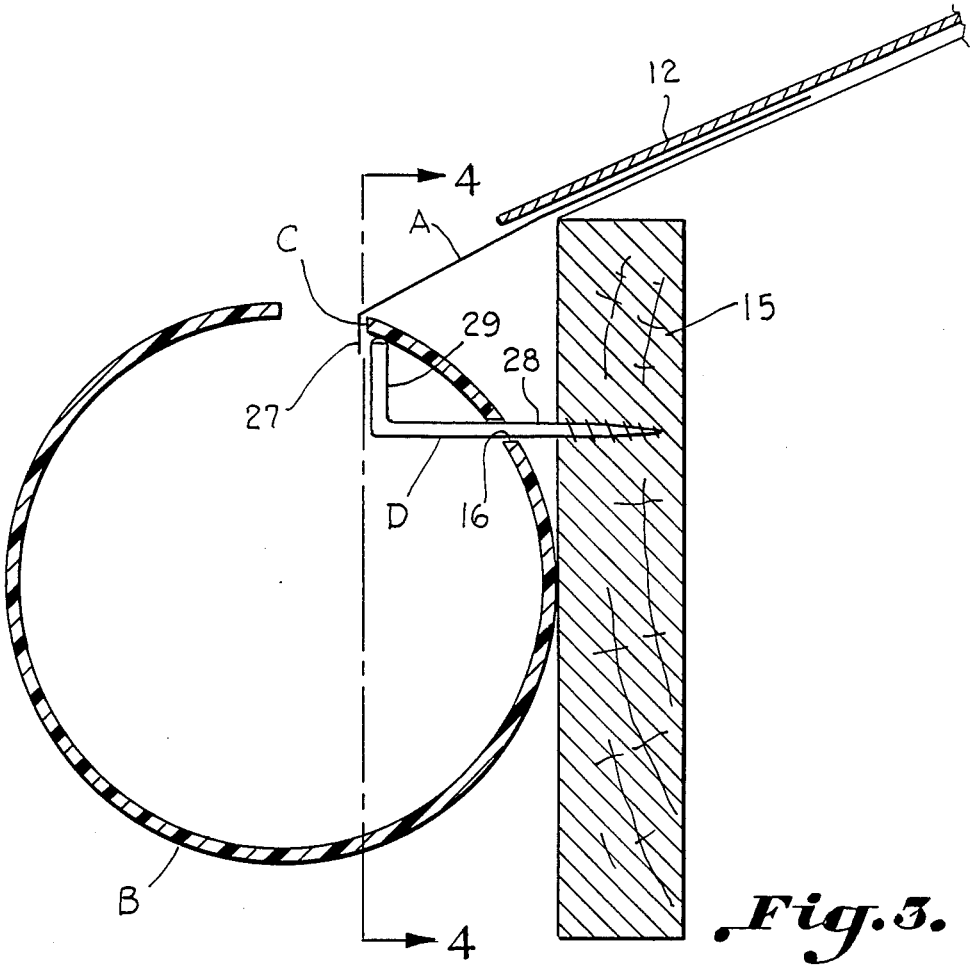
FIG. 3 is a transverse sectional elevation illustrating a modified form of the invention wherein an extruded synthetic polymeric tube is provided with a slot for receiving a threaded member for support while permitting thermal expansion with a flat extention member passing beneath the eaves of the roof terminating in a narrow slot adjacent the apex of the tube.
Figure 4:
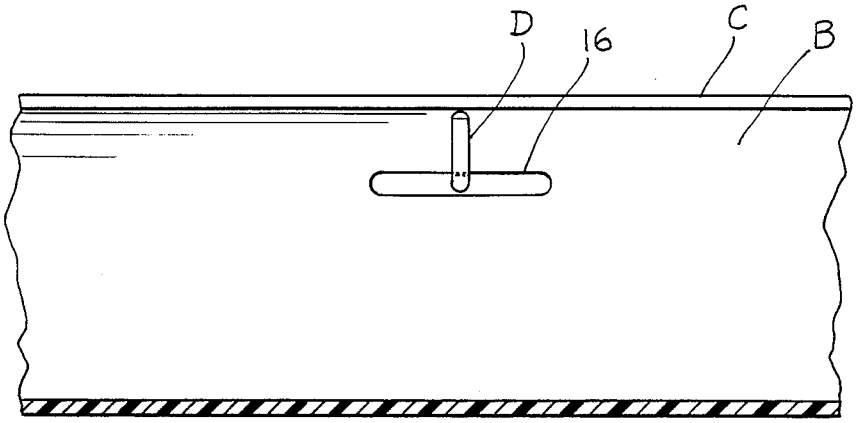
FIG. 4 is a longitudinal sectional elevation at a reduced scale taken on the line 4—4 in FIG. 3.
Figure 5:
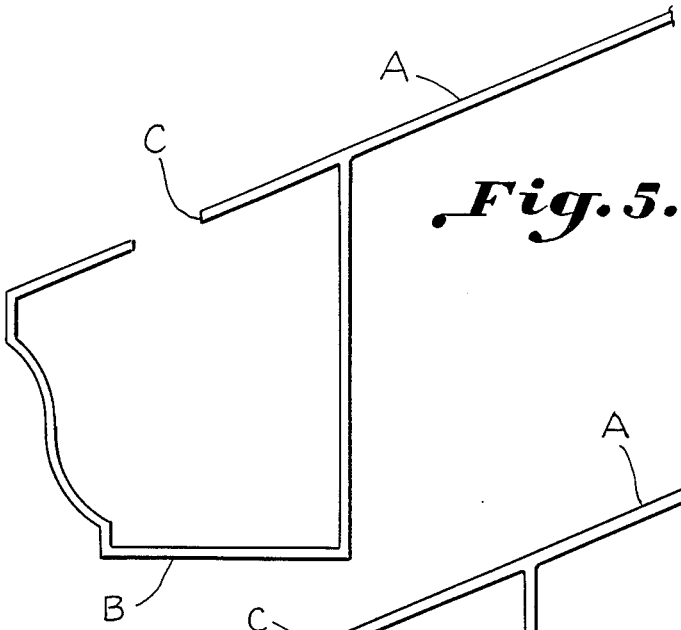
FIG. 5 is an end view illustrating a modified form of the invention wherein the extruded synthetic polymeric tube has a flat upper surface which includes a flat extension member terminating at a narrow slot in the apex portion of the tube.
Figure 6:
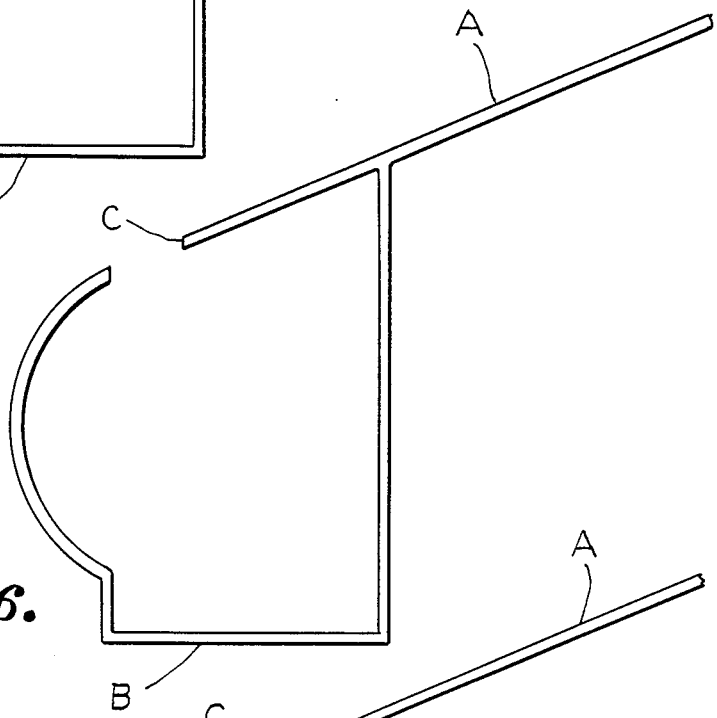
FIG. 6 is an end elevation showing another modified form of the invention wherein the slot is positioned in the apex of the tube adjacent one side thereof.
Figure 7:
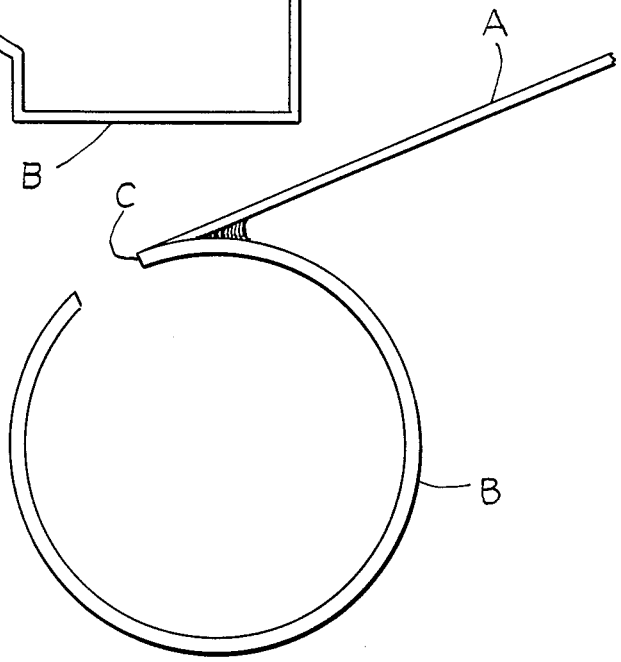
FIG. 7 is an end elevation illustrating a further modified form of the invention wherein a substantially circular tubular member is provided with a slot adjacent an apex portion in a far edge portion thereof to facilitate the passage of leaves thereover.

FIG. 3 illustrates a modified form of the invention wherein the flat extension member A has a down turned portion 27 which defines the free edge adjacent the slot C. The fastening member D includes a threaded shank portion 28 and an upturned end 29 opposite the slot 16, which in this instance, is carried within an upper rear side of the tubular member. The slot 16 permits thermal expansion and facilitates installation since the fastening members D may first be aligned and secured in place and then the tubular member positioned by accommodating same by passing the slot over the upturned end 29. Other modified forms of the invention are illustrated in FIGS. 5, 6 and 7 wherein flat extension members A and extruded synthetic polymeric tubes B are integral. The extension members A support the tubes and position the tubes adjacent the facia board as through the use of slots and fastening members as described above.

It is thus seen that a gutter structure has been provided which will not collect leaves and which will not rust or corrode while at the same time the facia board is protected without the use of further material. The gutter of the present invention offers additional in that a tubular member is provided by a plastic extruded member which will be unitary and which has a coefficient of friction less than steel or aluminum facilitating expansion while having the added advantage of shedding leaves. The gutter is of simple construction which facilitates installation and maintenance.

Figure 8:
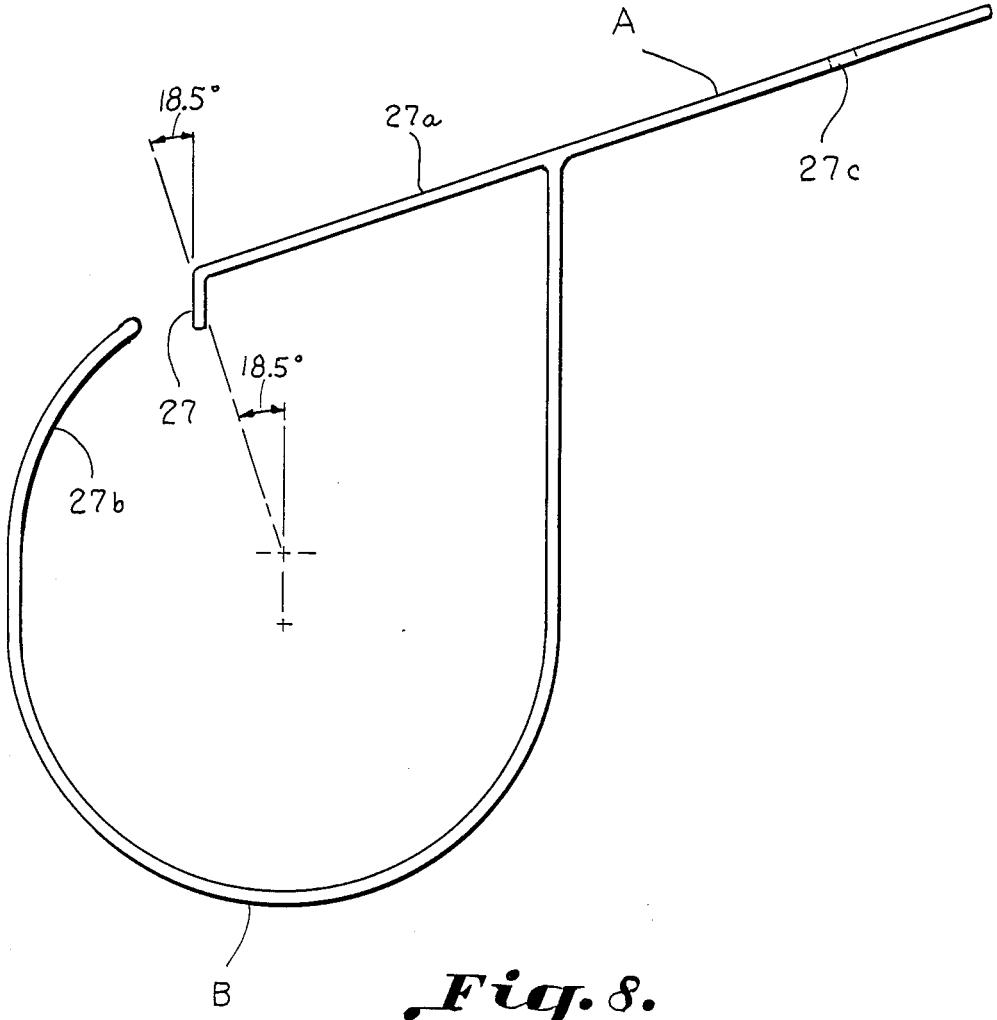
FIG. 8 is an end elevation, at an enlarged scale, illustrating another modified form of the invention.

FIG. 8 illustrates a further modified form of the invention wherein the extension member A is flat and forms one side 27*a* of the apex portion of the tube B carrying the free edge 27. The free edge is positioned adjacent the intersection of the extension member with a line projected at right angles thereto from a center of the upper surface 27*b* on the other side of the slot C. No straps or braces are required for installation of the assembly which is provided in the extension member with a mounting slot 27*c* for receiving fastening members.

The point on the free edge 27 at which the drops of water depart from the normal slope of the roof is positioned at a point which is intersected by a line following the slope of the roof and a line projected from the center of the gutters top rounded section from a vertical position over to the slope of the roof. This point allows for the maximum degree of separation from the water drops and the leaves or debris.

Thus, provision is made for attachment to the roof for the ideal point of separation to rotate and conform to different degrees of sloped roofs as required.

It is thus seen that the separation of the leaves and water is accomplished by a structure which does not provide a near horizontal shield for debris to collect and does not have an outer lip beyond the slot projecting upward to catch and hold leaves and debris. The extension member A extends at the same slope as the roof, and the outer edge of the slot is approximately $\frac{1}{8}$ of an inch lower than the inner edge which virtually prevents any hang-up of leaves or debris.

While a preferred embodiment of the invention has been described using specific terms, such description is for illustrative purposes only, and it is to be understood that changes and variations may be made without departing from the spirit or scope of the following claims.

What is claimed is:

1. A gutter for use beneath the eaves of a roof adjacent a facia board comprising:

a substantially flat extension member extending beneath the eaves of the roof;

an extruded tube constructed of synthetic polymeric material;

said extruded tube including an apex portion defined by opposed inwardly extending upper surfaces, and a narrow slot between said opposed inwardly extending upper surfaces;

said extension member sloping downwardly and extending outwardly from the eaves to the extruded tube;

a free edge on one side of said slot for water to pass over into the extruded tube while separating leaves which pass over the upper surface on the other side of said slot;

said tube and said extension member forming an assembly;

means positioning said tube adjacent said facia board;

said flat extension member and said tube being extruded integrally;

said slot having a center line positioned on one side of a vertical center of said tube remote from said extension member; and said inwardly extending surface opposite said extension member being arcuate and presenting a free end terminating at least about $\frac{1}{8}$ inch below a line constituting a continuation of said extension member and said first mentioned free edge.

* * * * *